US005588311A

United States Patent [19]

Kiribuchi

[11] Patent Number: 5,588,311

[45] Date of Patent: Dec. 31, 1996

[54] CONTROL METHOD FOR A CARRIER OF A KNITTING MACHINE AND ITS APPARATUS

[75] Inventor: Takeshi Kiribuchi, Wakayama, Japan

[73] Assignee: Shima Seiki Manufacturing Ltd., Wakayama, Japan

[21] Appl. No.: 550,099

[22] Filed: Oct. 30, 1995

[30] Foreign Application Priority Data

Oct. 31, 1994 [JP] Japan ..... 6-292443

[51] Int. Cl.[6] ..... D04B 15/56

[52] U.S. Cl. ..... 66/60 R; 66/64

[58] Field of Search ..... 66/60 R, 64, 126 R, 66/128, 130

[56] References Cited

U.S. PATENT DOCUMENTS

| | | | |
|---|---|---|---|
| 3,673,819 | 7/1972 | Swanwick et al. | 66/126 R |
| 4,321,807 | 3/1982 | Strong | 66/126 R |
| 4,354,363 | 10/1982 | Inoue | 66/126 R X |
| 4,513,588 | 4/1985 | Lutz | 66/126 R |
| 4,821,534 | 4/1989 | Goller et al. | 66/64 X |
| 5,031,423 | 7/1991 | Ikenaga | 66/126 R |
| 5,109,681 | 5/1992 | Schmid et al. | 66/126 R |
| 5,398,527 | 3/1995 | Hirai et al. | 66/64 X |

FOREIGN PATENT DOCUMENTS

| | | | |
|---|---|---|---|
| 0415512A1 | 3/1991 | European Pat. Off. . | |
| 0523916A1 | 1/1993 | European Pat. Off. . | |
| 3000853 | 1/1991 | Japan | 66/126 R |
| 3-54150 | 11/1991 | Japan . | |
| 854392 | 11/1960 | United Kingdom | 66/126 R |
| 2064599 | 6/1981 | United Kingdom . | |

OTHER PUBLICATIONS

Patent Abstracts of Japan 03090665A filed Aug. 31, 1989.
Patent Abstracts of Japan 5–25758 filed Jul. 11, 1991.

*Primary Examiner*—John J. Calvert
*Attorney, Agent, or Firm*—Nikaido, Marmelstein, Murray & Oram LLP

[57] ABSTRACT

A carrier of a flat knitting machine is configured to make a preparatory run in synchronization with a carriage, then the carrier is caught by a pin of the carriage. During this catching, the servo motor of the carrier side is driven to generate a constant torque in the direction for braking a carriage.

6 Claims, 6 Drawing Sheets

CONTROL METHOD FOR A CARRIER OF A KNITTING MACHINE AND ITS APPARATUS

FIELD OF THE INVENTION

The present invention relates to control of a carrier of a knitting machine such as flat knitting machine.

PRIOR ART

It is known that a carrier and a carriage are belt-driven by servo motors, respectively, to synchronize the carrier to the carriage (for example, Japanese Utility Model Publication No. HEI-3-54150). According to this method, the carrier can be made to stand at any desired position, and the dead time for the carriage to fetch the carrier can be eliminated. Further more, the impact noise generated when the carriage catches the carrier can be reduced, and the carrier can be made to stand just close to the corresponding knitting portion, which results in a higher precision of patterning.

The problem, however, lies in how the carrier and the carriage are synchronized with each other. For example, the servo motors have control errors. The positions of the carriage and the carrier do not necessarily agree with the desired values. Such errors are not limited to those of the servo motors. They are also generated by a variety of causes such as the installation errors and shrinkage/elongation of the belts. When such errors are neglected, the synchronization can not be achieved, and knitting can not be done. To cope with the problem, Japanese Utility Model Publication No. HEI-3-54150 proposes to detect the number of rotation of the carriage-driving servo motor to control the servo motor of the carrier side. The number of rotation of the servomotor of the carriage side is detected by a rotary encoder, and the servo motor of the carrier side is controlled so that the position and the velocity of the carrier agree with the position and the velocity of the carriage. According to this method, however, the time required for the sensor to detect the number of rotation of the motor of the carriage side and the time for the motor of the carrier side to catch up with the carriage side generate a control lag. To overcome the problem, it is necessary to keep the carriage driving velocity low so that the carrier can easily catch up with the carriage.

SUMMARY OF THE INVENTION

The objects of the present invention are 1) to eliminate the need of synchronizing the carrier and the carriage with each other,
2) to improve the precision of patterning,
3) to eliminate overload of the second servo motor for driving the carrier, and
4) to reliably bring the carrier to engage with the carriage and catch the carrier by the carriage.

The auxiliary objects of the present invention are 5) to increase the force for holding the carrier to the carriage,
6) to keep constant the force for holding the carrier to the carriage, and
7) to make the catching easier by extending the flat surface of the carrier onto which the bottom of a pin rests when the pin is made to descend onto the carrier.

The control method for a carrier according to the present invention is, in a control method for a carrier of a knitting machine, wherein the knitting machine is provided with a carriage for driving the needles of a needle bed and a carrier for feeding yarn to the needle bed and the carriage is driven by the first servo motor and the carrier is driven to travel on a carrier rail by the second servo motor, characterized in that a pin of a carrier catching apparatus connected to the carriage is made to engage with the carrier so as to catch the carrier by the carriage and, during the catching, the output torque of the second servo motor is subjected to a limitation.

The control apparatus for a carrier according to the present invention is, in a control apparatus for a carrier of a knitting machine, wherein the knitting machine is provided with a carriage for driving the needles of a needle bed and a carrier for feeding yarn to the needle bed and the carriage is driven by the first servo motor and the carrier is driven to travel on a carrier rail by the second servo motor, characterized in that said control apparatus comprises a carrier catching apparatus connected to said carriage, and having a pin and a means for lifting/lowering the pin so that the pin is arranged to engage with the carrier when the pin is lowered, and a control means for subjecting the output torque of the second servo motor to a limitation when the pin is lowered.

The limitation to the output torque may be given to both the positive and negative sides of the torque, in other words, to limit the absolute value of the torque within a limit. Or the limitation to the output torque may be set only on one side, either positive side or negative side. Preferably, the torque limitation is set for the direction in which carrier brakes the carriage. According to this arrangement, the carriage is subjected to the running resistance of the carrier on the carrier rail and to the torque from the servo motor of the feeder side (the second servo motor) being equal to or smaller than the limited torque, both in the form of friction. These frictions provide the holding force between the carriage and the carrier. When the limited torque is set in such a way that the carrier brakes the carriage, the holding force is approximately determined by the sum of the running resistance of the carrier itself and the output torque of the second servo motor, and the holding force is increased. In contrast, when the limited torque is set in such a way that the carrier accelerates the carriage, the holding force is determined by the difference between the output torque of the second servo motor and the running resistance of the carrier and the holding force is decreased.

The torque limitation is to give a non-synchronous control to the servo motor of the carrier side, namely, to give a control so that the carrier does not synchronize with the carriage, and to limit the output of the servo motor of the carrier side below the output rating. One example of the method of torque limitation is that, when the carriage catches the carrier with the pin, the output of the second servo motor is kept at a virtually constant level. Or preferably, the desired output of the second servo motor during catching is set at a limited torque. The direction of the torque is preferably for braking the carriage. As a result, the braking force by the second servo motor becomes constant, and the holding force between the carriage and the carrier gets stabilized. Second example of the torque limitation method is that, during catching, a velocity a little smaller than the carriage's velocity is set as the desired velocity of the carrier, or the desired position of the carrier is set a little shorter than the desired position of the carriage; thus the servo motor of the carrier side is given a feedback control, etc. so that the carrier lags a little behind the carriage in either velocity or position. When the carrier is being caught by the carriage, the carrier travels faster than the desired value of control or the carrier travels ahead of the desired position. Hence the servo motor of the carrier side gives output so as to brake the carrier. This braking torque (the output torque from the second servo motor in the direction opposite to that of carriage travelling) is subjected to an upper limit.

The function of the present invention will be described in the following. The carrier is given a preparatory run by the second servo motor almost in synchronization with the carriage until the carrier is caught by the carriage with the pin, etc. Once the catching gets started, the torque limitation is given to the second servo motor to prevent overload. If the output torque is opposite to that of the carriage side, the sum of the output torque of the second servo motor and the running resistance of the carrier is applied to the carriage during the catching, and this value is equal to the holding force between the carriage and the carrier. Due to this holding force, the contact between the carriage and the carrier is stabilized, and the vibration of the carrier relative to the carriage is prevented. If the output torque is in the same direction as that of the carriage side, the difference between the output torque of the second servo motor and the running resistance is applied to the carriage during the catching, and this is the holding force of the carrier. When the catching is ended, the carrier will stand at a specified position and wait for the next catching.

The carrier makes a preparatory run almost in synchronization with the carriage until being caught with the pin, and stands at the second desired position when the catching is reset. During the catching, the carrier is held to the carriage by the output torque of the second servo motor. As a result of these actions, the precision of patterning is improved if the carrier is braked by the second servo motor during the catching, the flat surface of the carrier onto which the pin is held can be extended for easier catching.

The most desirable form is that the limited torque is given in the direction opposite to the output torque of the motor of the carriage side and the second servo motor is driven by the limited torque. In this way, it is sufficient to give the second servo motor an instruction to generate the limited torque; the control is easy. The holding force becomes constant and the engagement between the carriage and the carrier becomes more stable.

EMBODIMENT

Figure 1A:
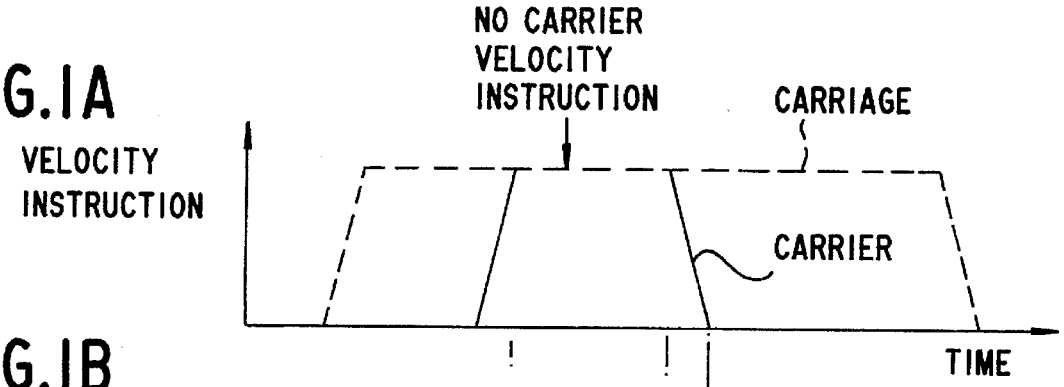
FIG. 1 A waveform chart snowing the control of the carrier in an embodiment.
Figure 1B:
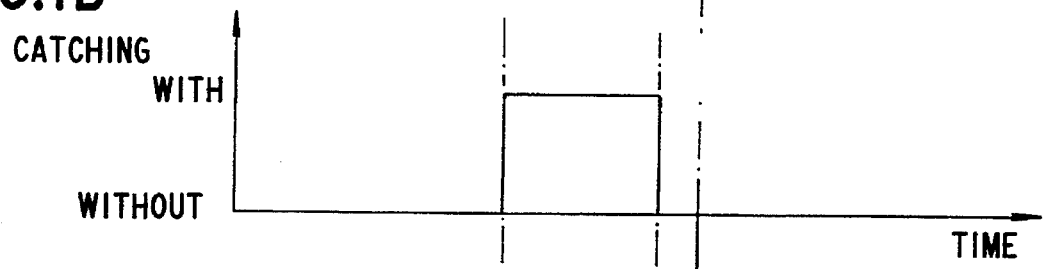
Figure 1C:
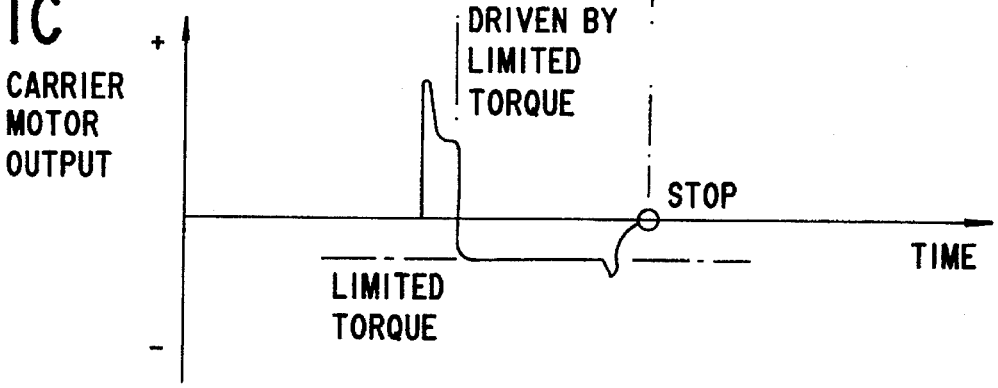
Figure 1D:
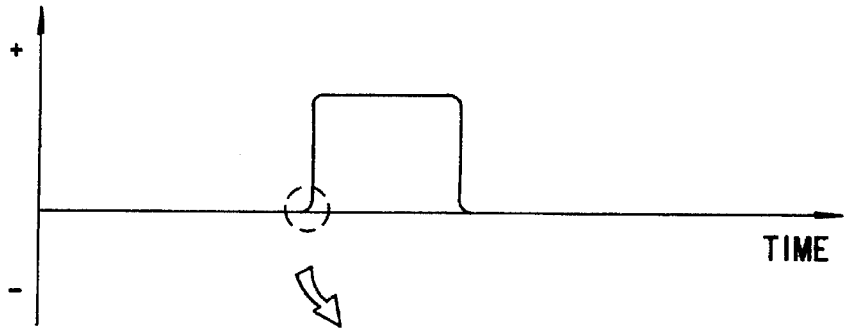
Figure 1E:
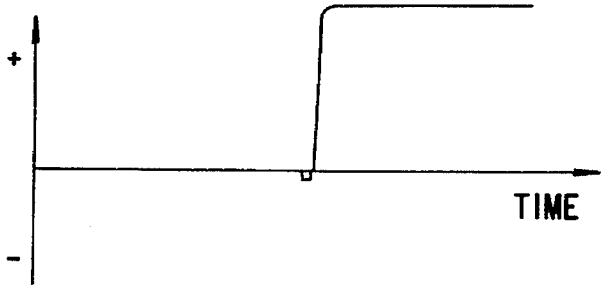
Figure 2:
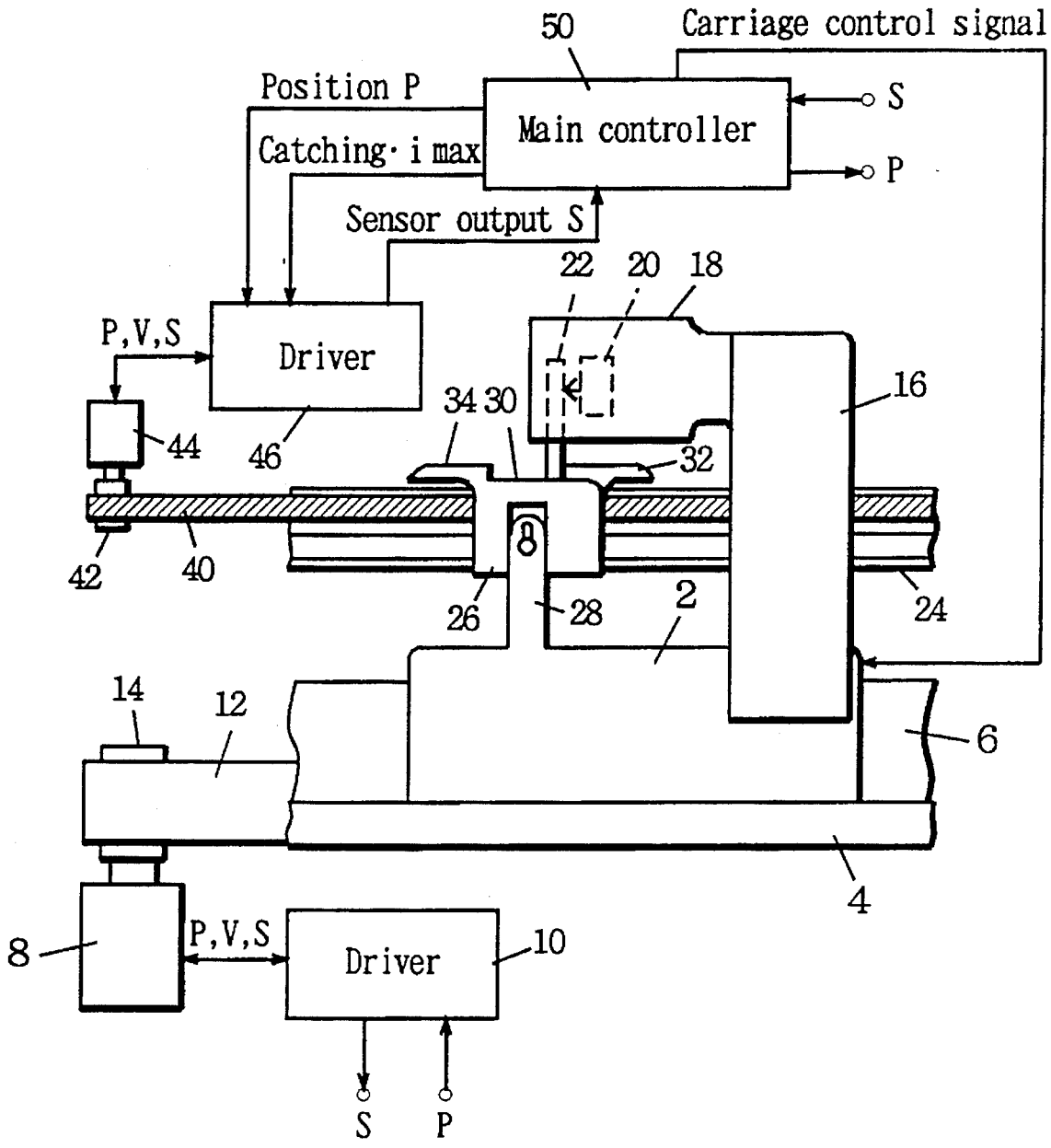
FIG. 2 A partial front view showing the construction of a flat knitting machine of the embodiment.

An embodiment and its modification are shown in FIG. 1 through FIG. 7. FIG. 2 shows the construction of a flat knitting machine. 2 is a carriage with two cams, four cams, etc., runs on a carriage rail 4 and controls needle beds 6 such as V-bed or 4-bed. The carriage 2 is made to travel on the rail 4 by a first servo motor 8 and a driver 10, and the travelling is effected by a tooth belt 12 and a pulley 14. The carriage 2 is provided with an arm gate 16 which straddle over the needle bed 6. The arm gate 16 is provided with a carrier catching apparatus 18. The carrier catching apparatus 18 is provided with pins 22 which are raised and lowered by multiple solenoids 20, 20. The configuration of such a carrier catching apparatus 18 is well known, for example, in Japanese Patent Publication No. SHO-62-29539.

Multiple carrier rails 24 are installed above the needle beds 6, and each of the carrier rails 24 is provided with four carriers 26. The carrier 26 is provided with a yarn rod 28, and a yarn feeder, which is not illustrated, is mounted at the top of the yarn rod 28. During knitting, the yarn rod 28 is pressed downward by the carrier catching apparatus 18, through a cam mechanism described, for example, in Japanese Provisional Patent Publication No. HEI-5-25758, and in turn the yarn feeder descends to the knitting position on the needle bed 6. The carrier 26 is provided with a flat surface 30 on the top at the center, a right protrusion 32 beyond the flat surface 30 on the right, and a left protrusion 34 this side the flat surface 30 on the left. The shoulders of the protrusions 32, 34 or the vertical surfaces between the protrusions 32, 34 and the flat surface 30 are pressed by the pin 22 to train. Thus the carrier catching apparatus 18 lowers the pin 22 onto a desired carrier 26 to train it. Each carrier rail 24 is provided with four tooth belts 40, and only one of such belts is illustrated here. The tooth belt 40 is designed to move the carrier 26 sidewise, and is driven, through a pulley 42, by a second servo motor 44 and a driver 46.

50 is a main controller for the entire flat knitting machine and controls two drivers 10, 46, the carriage 2, and the solenoids 20 of the carrier catching apparatus 18. The main controller 50 controls the carriage 2 and the carriers 26 according to the given knitting data. To control the carriage 2, the main controller 50 inputs a desired position signal P to the driver 10. The driver 10 controls the servo motor 8 according to the desired position signal. The servo motor 8 is provided with a sensor for detecting the number of rotation, and the sensor integrates the number of rotation to detect the position. These results of detection are fed back to the driver 10 as the sensor outputs S of the position and velocity of the carriage 2. The driver 10 controls the carriage 2 so that the carriage 2 runs by the given position at the given time. The sensor outputs S are reported to the main controller 50 by the driver 10.

In a similar manner, The main controller 50 controls the second servo motor through the driver 46. The control here is similar to the case of the driver 10; the main controller 50 instructs the driver 46 a desired position P or a desired velocity of the carrier 26, and the driver 46 controls the servo motor 44 according to the given value. The servo motor 45 detects its own number of rotation as the velocity signal, and integrates the number of rotation to obtain a position signal. The servo motor 45 inputs these sensor outputs to the driver 46 to make feedback control of the position and velocity. The sensor outputs are reported by the driver 46 to the main controller 50. The control given by the driver 10 and that given by the driver 46 differ from each other in that a current limit signal is given to the driver 46 during catching (catching by means of the pin 22). The current limit signal is a signal for limiting the output torque of the servo motor 44. The contents of the output limitation will be described later with reference to FIG. 4 and FIG. 5.

In addition to the functions mentioned above, the main controller controls the carriage 2, and also controls the solenoid 20 to catch and hold a specified carrier 26 to the carriage 2. In the embodiment, the main controller 50 does not directly control the servo motors 8, 44 but gives local control via drivers 10, 46. The main controller 50, however, may give direct control. There is no need of providing each servo motor 44 with a dedicated driver 46. One driver 46 may control a plurality of servo motors 44. In the embodiment, the output of the servo motor 44 is determined by the instruction given by the main controller 50. However, during the preparatory running period of the carrier 26, the servo motor 44 may be controlled by giving the sensor output of the driver 10 to the driver 46 so that the velocity and position of the carrier 26 almost agree with those of the carriage 2 during the preparatory running.

Figure 3:
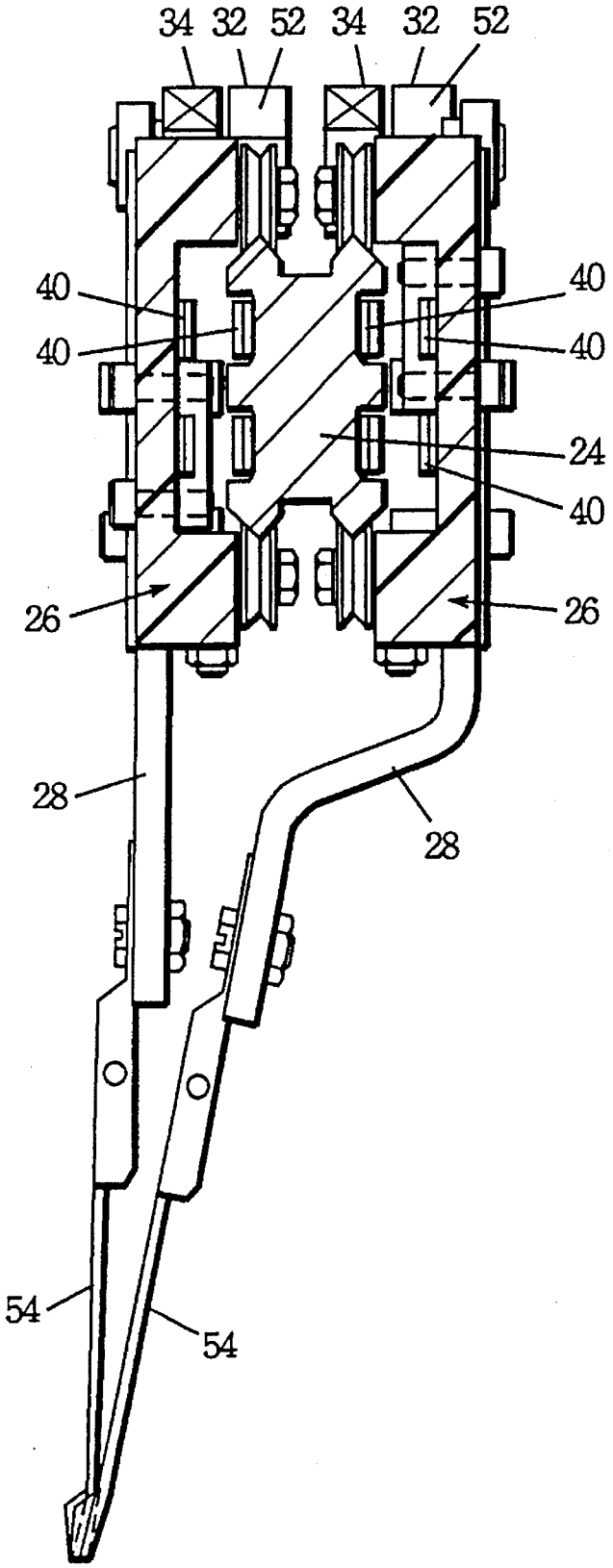
FIG. 3 A sectional view of a carrier rail and a carrier.

FIG. 3 shows the carrier rail 24 and the carriers 26. One carrier rail 24 is provided with four tooth belts 40, and a carrier 26 is attached to each tooth belt 40. In FIG. 3, protrusions 32, 34 are depicted in the upper part, and the shoulders 52 appear on the sides of the right protrusions 32. When the pin 22 is lowered, the pin 22 engage with the shoulder 52 to catch and hold the carrier 26. A yarn feeder 54 is attached to the top end of the yarn rod 28 to feed yarn to the needle bed 6.

Figure 4:
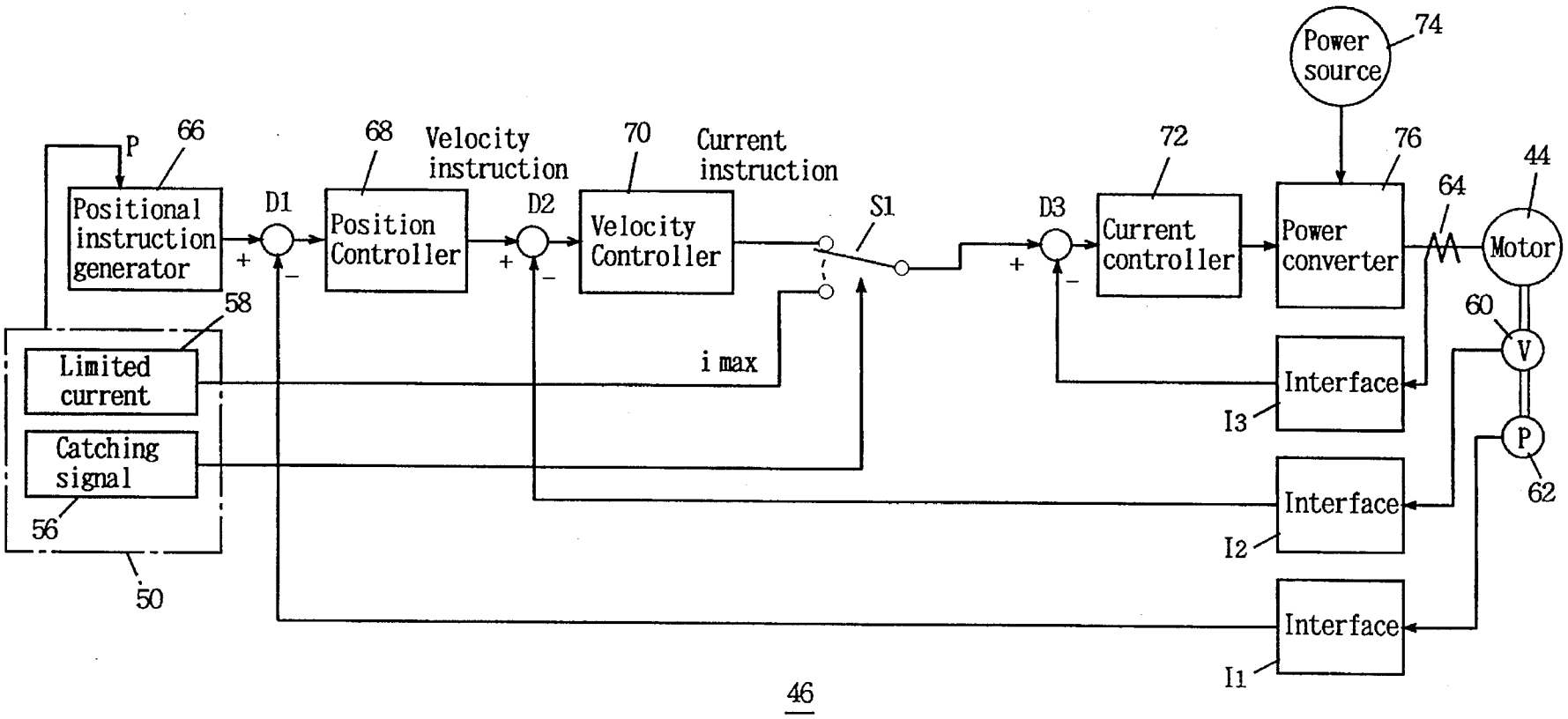
FIG. 4 A block diagram of the control circuit of the servo motor of the carrier.

FIG. 4 shows the configuration of the driver 46. The driver 46 operates by receiving the position instruction signal P or the desired velocity signal from the main controller 50, and in addition to them, the catching signal from the catching signal generator 56, and the current limit signal from the current limit signal generator 58. With regard to the operations during the non-catching period, the driver 46 monitors the number of rotation of the servo motor 44 by means of a velocity sensor 60 such as a rotary encoder. The output of the sensor 60 represents the velocity of the carrier 26. The driver 46 also integrates the signals of the velocity sensor 60 by means of the positional sensor 62. The signal from the positional sensor 62 corresponds to the position of the carrier 26. The driver 46 also detects the electric power given to the servo motor 44 by means of a current sensor 64. On the other hand, the driver 46 inputs the position instruction signal P from the main controller 50 to the positional instruction generator 66. A differential amplifier D1 detects and amplifies the error between the instructed position and the actual position to generate a velocity signal for eliminating the positional error by means of the position controller 68. The difference between the generated velocity instruction and the velocity signal from the interface 12 is amplified by a differential amplifier D2 and converted into a current instruction signal by a velocity controller 70. In the case of the velocity control, the difference between the desired velocity and the actual velocity is amplified by a differential amplifier and converted into a current instruction signal by the velocity controller 70. The converted current instruction signal is inputted, via a switch 81, into a differential amplifier D3, and the difference between the current instruction signal and the current signal from the interface 13 is amplified and inputted to a current controller 72 to control the electric power from a power source 74 by a power converter and give the controlled power to the servo motor 44. This is a normal configuration for the current control of the servo motor. In place of the current control, any control such as voltage control may be used.

During the catching, according to the current limit signal $i_{max}$, the servo motor is driven to generate the limited torque. The direction of the output torque thus generated is a direction for braking the carriage 2. The cases of the servo motors 8, 44 are shown below as examples. The servo motor 8 of the carriage 2 is, for example, a servo motor with the maximum output of 800 W. The servo motor 44 of the carrier 26 is a servo motor with the maximum output of 50 W. Next, the value of the current limitation given by the current limit signal $i_{max}$ is such that the sign of the output torque of the servo motor 44 is reverse to the running direction of the carriage 2, and the value is, for example, from 5 to 20 W in output. The limited torque is fairly small relative to the output of the servo motor 8, so it is safe to assume that the carriage 2, when catching the carrier 26, can move without being affected by the limited torque. Here the servo motor 44 is subjected to current control so the output torque is limited by the current limit signal $i_{max}$. In case of voltage control for example, the control voltage may be limited. What is important here is to generate a torque by the servo motor 44, of which direction is reverse to the direction of motion of the carriage 2, and to keep that torque constant during the catching.

Figure 5:
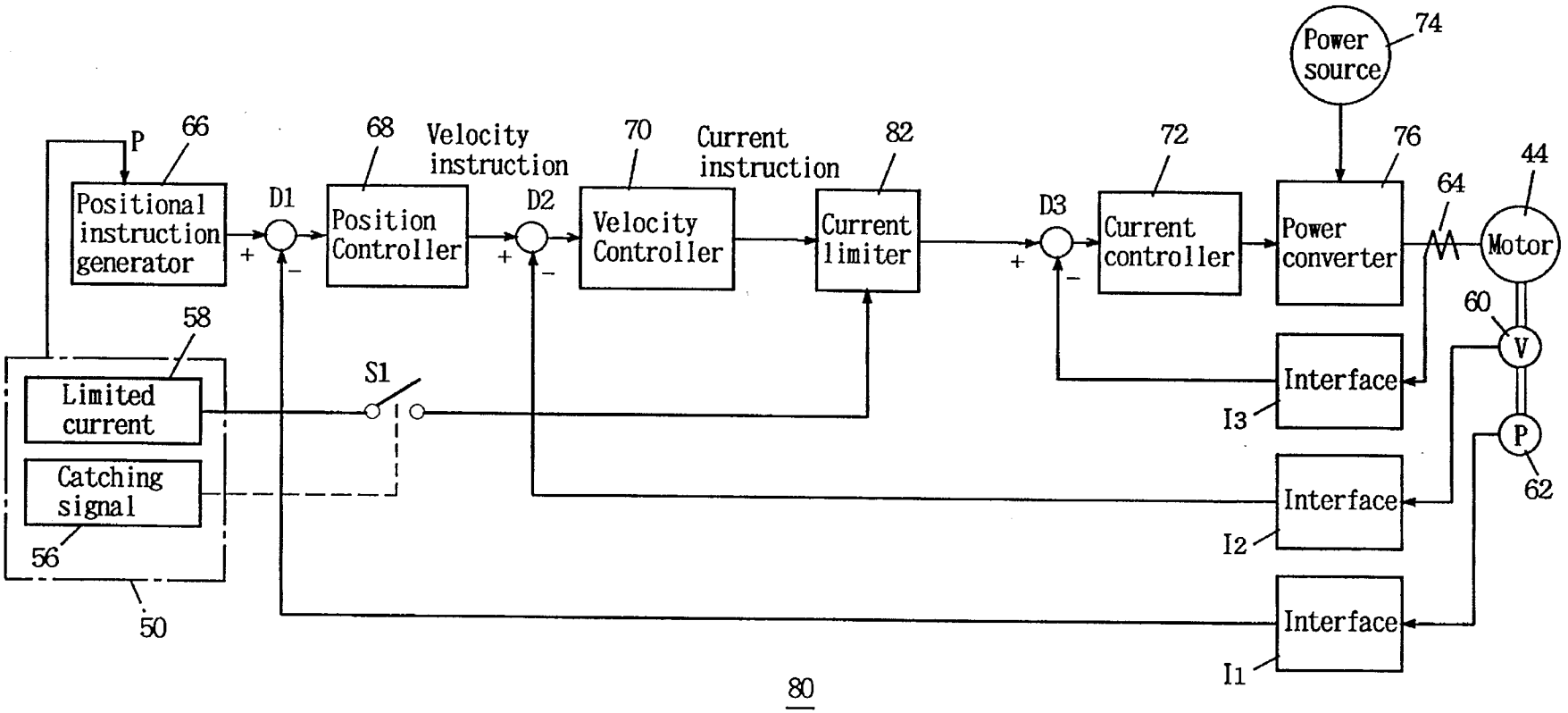
FIG. 5 A block diagram of the control circuit of the servo motor of the carrier according to a modification of the invention.

FIG. 5 shows a modification concerning the torque limitation of the servo motor 44. 80 is a new driver and 82 is a current limiter. The difference from the driver 46 of FIG. 4 is that during the catching the driver 82 gives either the positional instruction signal P or the velocity instruction signal to generate a current instruction signal, and limits the current instruction signal by the current limiter 82. With regard to the position and velocity, the driver 82 gives instructions so that the carrier 26 synchronizes with the carriage 2 till the catching by the pin 22 is started. During the catching, however, the driver 80 gives instructions so that the desired position of the carrier 26 is a little short of the carriage 2, in other words, the travelling velocity of the carrier 26 is a little smaller than the travelling velocity of the carriage 2. The carrier 26 is made by the pin 22 to travel at the same velocity with the carriage 2. Hence, when the desired position of the carrier 26 is set a little short of that of the carriage 2, or the desired velocity of the carrier 26 is set a little smaller than that of the carriage 2, the servo motor 44 will generate an output torque of which direction is reverse to the running direction of the carriage 2. Then this output torque is limited by the current limit signal i The driver 80 of FIG. 5 requires, in comparison with the driver 46 of FIG. 4, a higher precision for the positional instruction signal P which is given at the time of catching. The driver 80 is inferior to the driver 46 in the sense that if this precision is not sufficient the carrier 26 may outrun the carriage 2 to break the catching.

Now let us go back to FIG. 1 and assume that the driver 46 of FIG. 4 is used. The operation of the embodiment is as follows. FIG. 1—1) shows the velocity instructions to the carriage 2 and the carrier 26. The control may be given by either velocity instruction or position instruction, but in the diagram the control is indicated as velocity instructions. FIG. 1–2) shows the presence or absence of the catching by means of the pin 22. FIG. 1–3) shows the output of the servo motor 46 for the carrier 26. The current limit signal is given almost simultaneously with the start of the catching, and preferably a little later. FIG. 1–4) shows the pressure (holding force) between the carriage 2 and the carrier 26, and 4) is a magnified view of the change in the holding force at the start of the catching.

The carrier 26 makes preparatory running to synchronize with the carriage 2. The pin 22 is lowered to catch the carrier 26. It is difficult to completely synchronize the carrier 26 and the carriage 2 with each other. Hence there is a synchronization error of, for example, about 1 mm at the start of the catching. Shortly after the start of the catching, the current limit signal $i_{max}$ and the catching signal are given to the driver 46, and the output of the servo motor 44 is reversed to drop to the limited torque. As a result, the carrier is braked, and the pin 22 engages with the shoulder 52 to catch the carrier 26. The holding force is equal to the sum of the running resistance of the carrier 26 on the carrier rail 24 and the output torque of the servo motor 44. The carrier 26 is kept caught by the constant and large torque. Moreover, the tendency of the carrier 26 to lag behind the carriage 2 eliminates the synchronization error at the time of preparatory running. In contrast to it, if the carriage 2 and the carrier 26 are not subjected to the catching by the pin 22, the synchronization error of 1 mm will not be eliminated; it will remain through the entire knitting. This error will deteriorate the precision of patterning. The control with the driver 46 is simple; it is sufficient to generate the limited torque output during the catching. When the catching is over or when the pin 22 is lifted, the carrier can be stopped at any desired position to wait for the next catching.

If the driver 80 of FIG. 5 is used, a target signal of position or velocity is given to the servo motor 44 even during the catching, and the value is set in such a way that the carrier 26 lags a little behind the carriage 2. Then the positional sensor 62 detects that the present position is ahead of the desired position or the velocity sensor 60 detects that the actual velocity is exceeding the desired velocity, and to eliminate the error, the servo motor generates a limited torque within the range of the limited torque. The limited torque is not determined uniquely. When the precision of the target signal of position is low and the carrier 26 is controlled so that it travels at the same velocity with the carriage 2, the limited torque may become zero incidentally.

Figure 6:
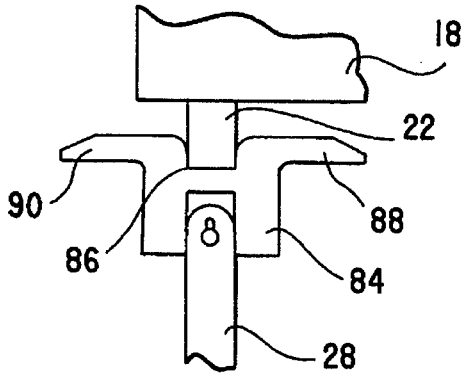
FIG. 6 A partial front view showing the carrier according to the modification of the invention.
Figure 7A:
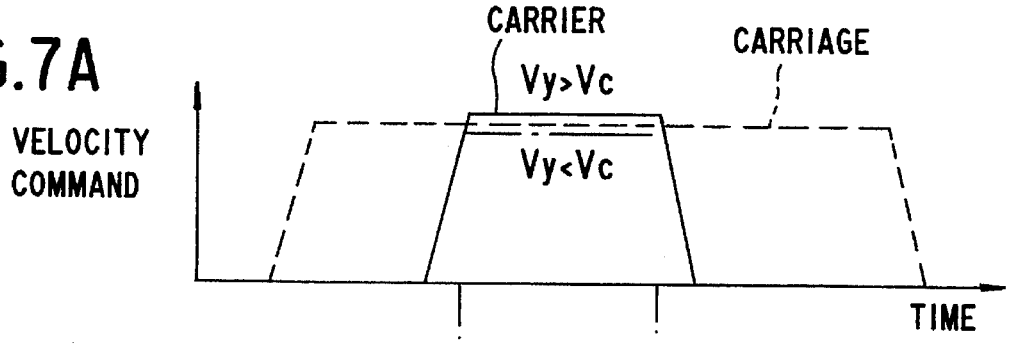
FIG. 7 A control waveform diagram of the carrier according to the modification of the invention.
Figure 7B:
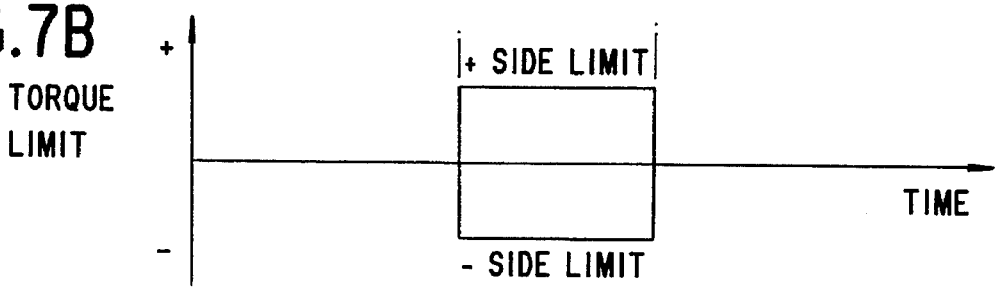
Figure 7C:
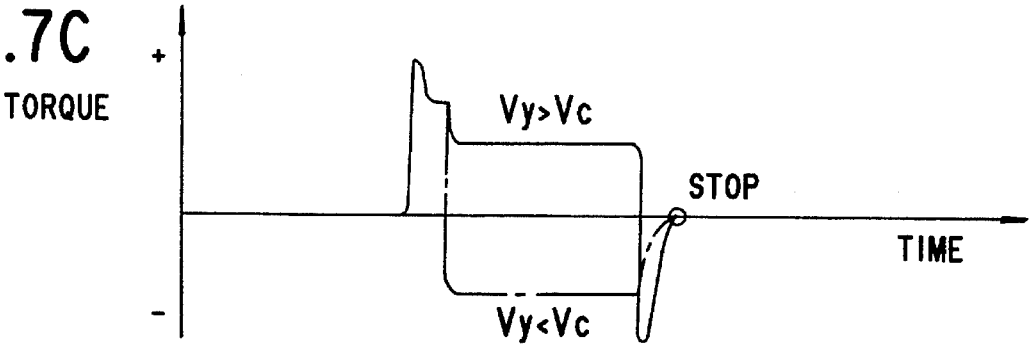

FIG. 6 and FIG. 7 show a modification 84 of FIG. 6 is a carrier, 86 is a flat surface, and 88 and 90 are protrusions on both sides of the flat surface 86. The width of the flat surface 86 is virtually equal to the width of the pin 22. In this case, even if the desired velocity of the carrier 26 is faster or slower than the velocity of the carriage 2, the braking force will be exerted. Thus during the catching, the servo motor 44 is subjected to, for example, two torque limits, a positive one and a negative one. As the width of the flat surface 86 is narrow, the synchronous control needs precision at the time of preparatory running of the carrier 26.

FIG. 7 shows a case wherein the desired velocity Vy of the carrier 26 during the catching is set faster than the velocity Vc of the carriage 2, and a case wherein the desired velocity Vy of the carrier 26 during the catching is set slower than the velocity Vc of the carriage 2. In the case of Vy>Vc, the carrier 26 will try to outrun the carriage 2, and the output torque will become equal to the limited torque of the positive side. In the case of Vy<Vc, the carrier 26 will try to halt the carriage 2 and the output torque will become equal to the-limited torque of the negative side. The setting as to whether the desired velocity Vy of the carrier 26 is faster or slower than the desired velocity Vc of the carriage 2 must be decided in advance. The selection of either one of the protrusions 88, 89 must be decided in advance as well. Here the desired value of the carrier 26 is specified in terms of velocity, but it may be specified in terms of position.

I claim:

1. A control method for a carrier of a knitting machine, wherein the knitting machine includes at least a carriage for driving the needles of at least a needle bed and at least a carrier for feeding yarn to the needle bed, and wherein the carriage is driven by a first servo motor and the carrier is driven to travel on a carrier rail by a second servo motor, the method comprising figuring a pin of a carrier catching apparatus connected to the carriage configured to engage with the carrier so as to catch the carrier by the carriage and providing a torque limiting means coupled to said second servo motor such that, during the catching, an output torque of the second servo motor is limited by the torque limiting means.

2. A control method for a carrier of a knitting machine of claim 1, wherein, during the catching, controlling the output torque of the second servo motor by the torque limiting means to be generated in a direction which is reverse to a running direction of the carriage.

3. A control method for a carrier of a knitting machine of claim 2, wherein the torque limiting means controls the output torque in the reverse direction to be virtually constant.

4. A control apparatus for a carrier of a knitting machine, wherein the knitting machine includes at least a carriage running on and for driving the needles of at least a needle bed and at least a carrier for feeding yarn to the needle bed, and wherein the carriage is driven by a first servo motor and the carrier is driven to travel on a carrier rail by a second servo motor, wherein said control apparatus for a carrier comprises:

a carrier catching apparatus connected to said carriage, and having at least a pin and lifting/lowering means thereupon for lifting/lowering the pin so that the pin engages with the carrier when the pin is lowered by the lifting/lowering means; and control means coupled to said carrier catching apparatus and said second servo motor for driving said lifting and lowering means, and for subjecting an output torque of the second servo motor to a limitation when the pin is lowered.

5. A control apparatus for a carrier as recited in claim 4, wherein said control means controls the output torque of the second servo motor so that a direction of said output torque is reverse to a running direction of the carriage and is virtually constant when the pin is lowered.

6. A control apparatus for a carrier as recited in claim 4, wherein said control means controls a desired travelling velocity of the carrier to be lower than a travelling velocity of the carriage and subjects the output torque of the second servo motor to a limitation when the pin is lowered.

* * * * *